United States Patent [19]

Blessing

[11] 4,283,047

[45] * Aug. 11, 1981

[54] FACING PLY SEPARATOR

[75] Inventor: Hubert Blessing, Dallas, Tex.

[73] Assignee: Levi Strauss & Co., Del.

[ * ] Notice: The portion of the term of this patent subsequent to Mar. 13, 1996, has been disclaimed.

[21] Appl. No.: 940,610

[22] Filed: Sep. 8, 1978

Related U.S. Application Data

[63] Continuation of Ser. No. 807,348, Jun. 17, 1977, Pat. No. 4,143,871, which is a continuation-in-part of Ser. No. 701,857, Jul. 1, 1976, abandoned.

[51] Int. Cl.[3] ..... B65H 3/22

[52] U.S. Cl. ..... 271/10; 271/18.3; 271/22

[58] Field of Search ..... 271/18.3, 19, 21, 22, 271/95, 10, 4, 64, 106, 107, 300

[56] References Cited

U.S. PATENT DOCUMENTS

| | | | |
|---|---|---|---|
| 793,009 | 6/1905 | Miller | 271/18.3 |
| 1,780,195 | 11/1930 | Kinney | 271/18.3 |
| 2,878,016 | 3/1959 | Russell et.al. | 271/168 X |
| 3,253,824 | 5/1966 | Southwell et al. | 271/22 X |
| 3,500,999 | 3/1970 | Lippke | 271/64 X |
| 3,517,831 | 6/1970 | Hahn . | |
| 3,563,378 | 2/1971 | Myers . | |
| 3,765,672 | 10/1973 | Conner | 271/10 |
| 3,831,778 | 8/1974 | Biber | 271/18.3 X |
| 3,981,495 | 9/1976 | Bijttebier | 271/18.3 |
| 4,143,871 | 3/1979 | Blessing | 271/18.3 X |

*Primary Examiner*—Bruce H. Stoner, Jr.
*Attorney, Agent, or Firm*—Philip M. Shaw, Jr.

[57] ABSTRACT

Alternate facing plies in a single stack are separated by this apparatus into two separate piles. The apparatus of the invention includes a head for differentiating each top layer from the feed stack and a transporter for transporting the differentiated top layers alternately to a first location and to a second location. The differentiating head includes a movable, rotating element for curling back one or more of the edges of the top layer from the edges of the next underlying layer in the stack and thereafter lifting the layer with the curled edges away from the stack.

3 Claims, 38 Drawing Figures

FIG. 1.
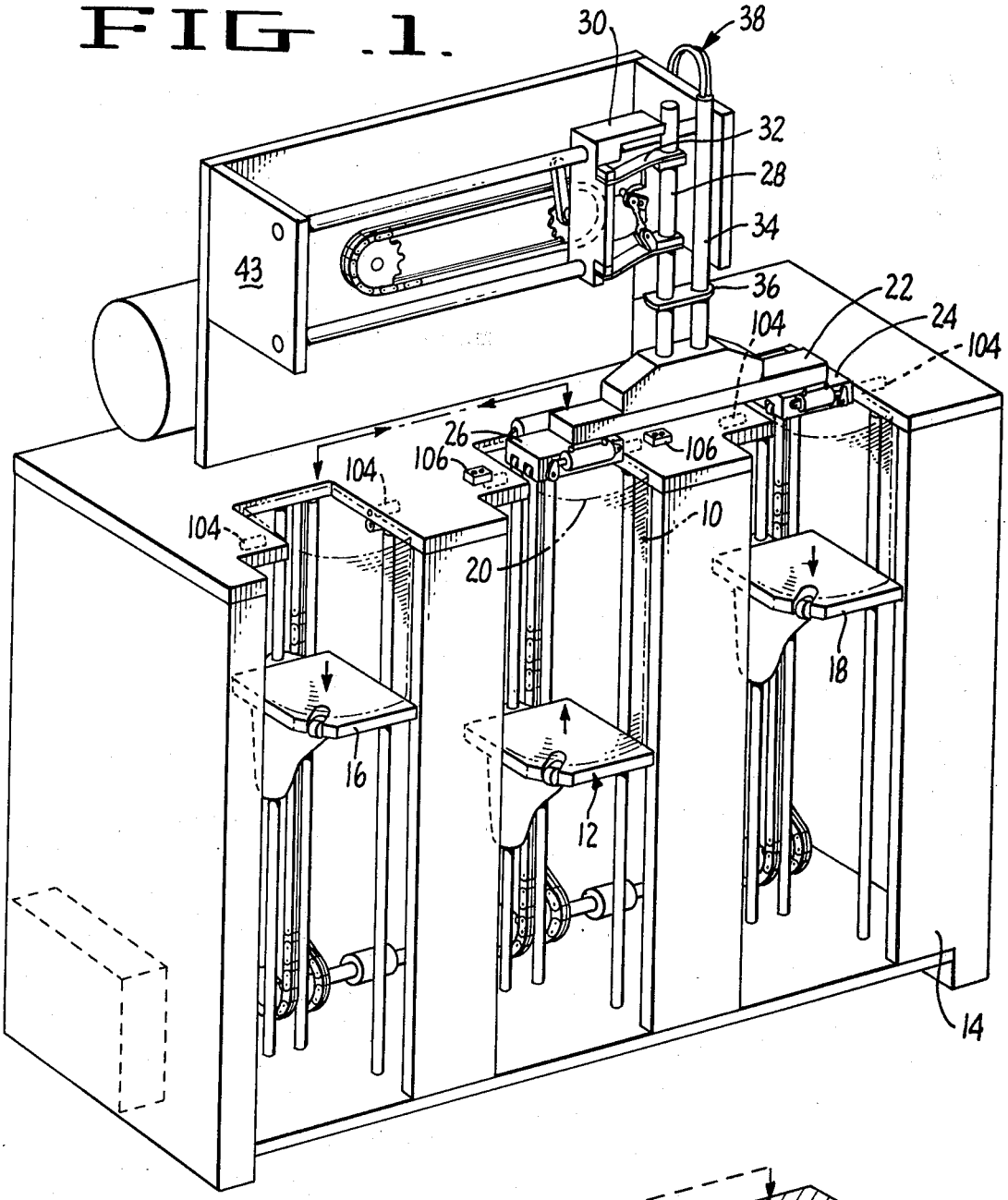
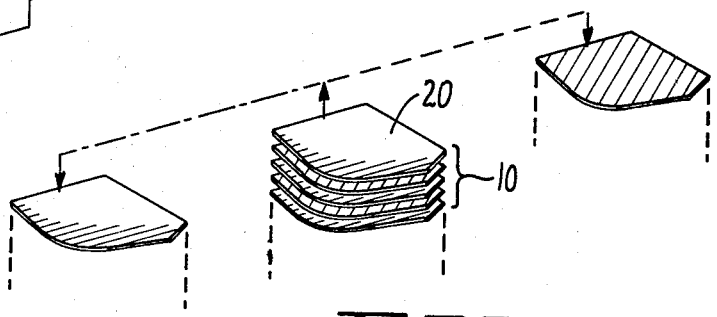
FIG. 2.

FIG. 3.
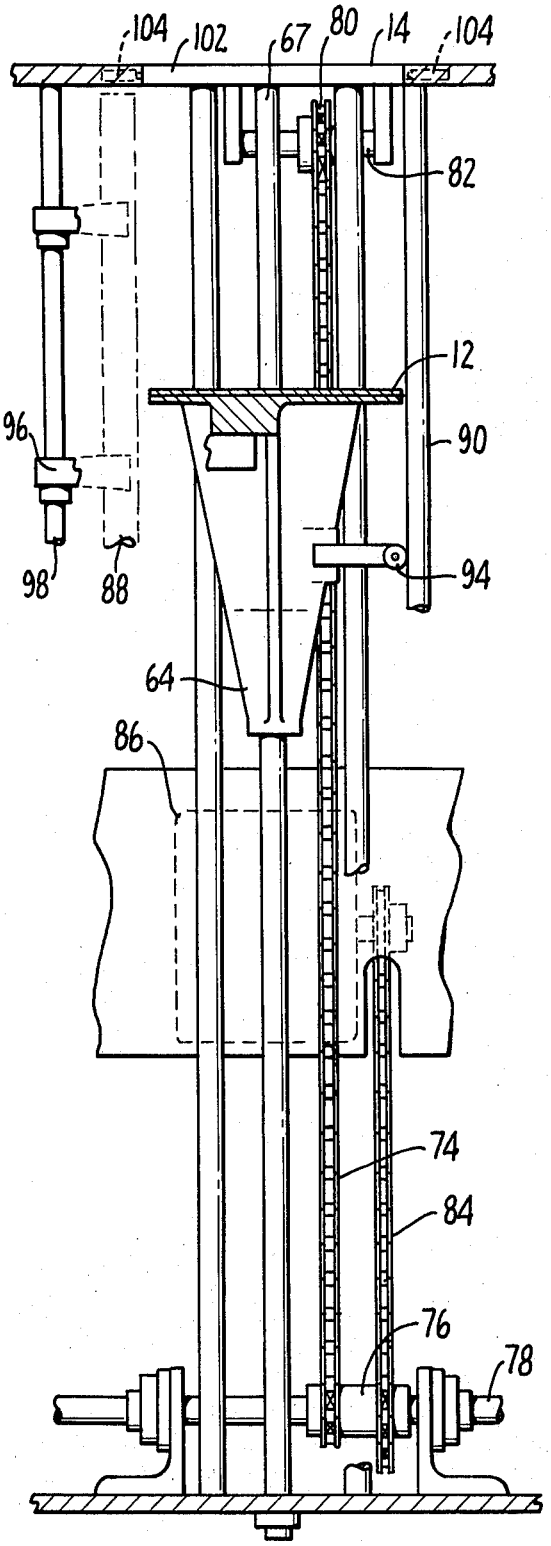
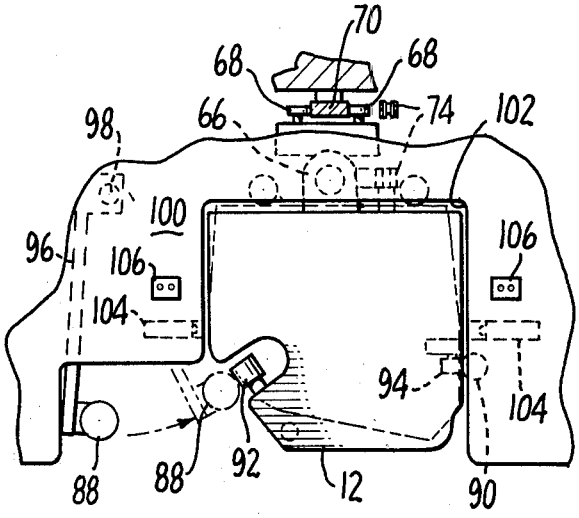
FIG. 4.
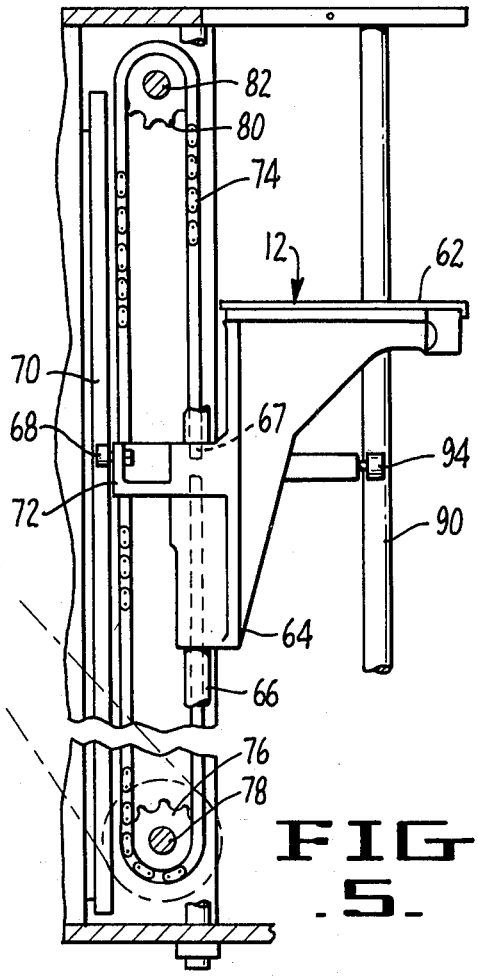
FIG. 5.

FACING PLY SEPARATOR

CROSS-REFERENCE TO RELATED APPLICATION

This application is a continuation of my co-pending U.S. application, Ser. No. 807,348, filed June 17, 1977, now U.S. Pat. No. 4,143,871 for FACING PLY SEPARATOR, which in turn is a continuation-in-part of my copending application Ser. No. 701,857, July 1, 1976, now abandoned.

BACKGROUND OF THE INVENTION

The invention relates to automatic apparatus for separating alternately facing fabric workpieces from a single stack into two separate stacks.

It is often desirable in the garment fabrication industry to separate layers of stacked fabric workpieces from each other and to transport them to other work stations. Such prior art separating devices are described in U.S. Pat. Nos. 3,253,824 and 3,042,505. As pointed out in those patents, separating stacked fabric layers is extremely difficult since the layers of fabric, during cutting, tend to have their end threads interwoven and are thereby bonded together. It requires considerable ingenuity to separate each layer of fabric from this bonding interengagement of the end threads without simultaneously disrupting the placement of the layers in the stack.

It is desirable not to disturb the placement of the layers in the stack in order that the workpieces may be accurately aligned with respect to the separating apparatus and so that after separation they can be transported to another work station with a predetermined orientation. If the fabric layers are misaligned, they will not be properly transported in an aligned relationship to the next work station, but, instead, will be mis-positioned upon reaching the subsequent work station.

The mechanisms for separating such layers of stacked fabric workpieces are known in the trade as differentiators. The differentiators described in the above two referenced patents rely on a clamping member working in conjunction with a rotating friction member to peel back a layer of fabric while holding the remaining stack stationary. This type of differentiator has many disadvantages well known to the trade, among them, the problem that it does not easily adapt to different types of fabric, nor is it entirely effective in separating the layers without disturbing the underlying layers or picking up more than one layer of fabric at the same time.

More suitable types of differentiators are described in U.S. Pat. Nos. 793,009 (Miller) and 3,981,495 (Bijttebier) which disclose a pair of horizontal, rotatable cylinders having needles which project in opposite directions and which are lowered to rest on the top fabric layer of a stack of fabric workpieces. The cylinders are counter-rotated to drive the needles into the top layer and then are lifted to pull away the top layer from the stack. This type of differentiating head is more effective than other types of differentiating heads for some applications. However, it also suffers from a disadvantage in that unless the needles penetrate the fabric evenly when the cylinders are counter-rotated there may be a tendency to shift the top layer horizontally, thus causing it to be misaligned.

In one garment industry operation, left and right pocket facings are cut simultaneously on a spreading table from a fabric stack having alternately face-up and face-down layers. The result is a plurality of smaller stacks of alternating left and right facing plies. It then becomes necessary to separate these left and right facing plies into two separate stacks of all left and all right facing plies. In order to do this automatically, it is not only necessary to effectively separate the alternate left and right facing plies from the stack without misalignment, as described above, but it is also necessary to detect whether the stack somehow contains two facing plies oriented in the same direction, that is, face-up or face-down. It is further necessary to detect whether one of the differentiated plies has been dropped by the differentiating head since this would cause one of the stacks to be short in the number of facing plies.

SUMMARY OF THE INVENTION

The above and other disadvantages are overcome by the present invention of an improved apparatus for sequentially separating into a plurality of stacks alternate layers of sheet-like workpieces from a single feed stack of sheet-like workpieces. The improved apparatus comprises means for differentiating each top workpiece layer from the feed stack and means for transporting the differentiated top workpieces alternately to a first location and to a second location. The differentiating means includes means for curling back one or more edges of the workpiece from the edges of the next underlying workpiece layer in the stack and thereafter lifting the workpiece with the curled edge away from the stack. In the preferred embodiment, the workpieces have differently colored plane faces in alternate layers and the differentiating means includes photo optic means for detecting whether each differentiated workpiece is turned face-up or face-down.

In one preferred embodiment, the differentiating means simultaneously differentiates the topmost workpiece from the feed stack while releasing the previously differentiated workpiece at the first or second location. In this embodiment the differentiating head is movable and delivers the separated workpiece to a belt type transport which conveys the workpieces alternately to the first and second locations.

In this embodiment, separation is achieved using two or more of the following principles in combination: (1) different lateral motion of the top workpiece with respect to the next underlying (second) workpiece in combination with a negative pressure or force applied to the underlying layer to release interlocking weaving patterns and edge threads, (2) bending the top workpiece around a small radius so that by the forces of inertia, gravity and the vacuum between the second and third layers the second layer, upon release of the interlocking weave and edge threads, tends to fall away from the top workpiece as it passes around the bend and (3) placing the stress of separation along a line which moves across a plane which is parallel to the planes containing the flat surfaces of the workpiece, as opposed to trying to separate along the whole surface at once.

In the preferred embodiment, such separation of the topmost layer is aided by one or more separating rods which are movable horizontally and press against the topmost layer during its separation from the stack to thereby produce a moving bend in the topmost layer. This bend helps to disengage the threads and weave of the top layer from the threads of the next layer in the feed stack.

At the first and second locations, the differentiated workpiece layers are received onto separate elevators which index downwardly by the thickness of each ply as it is released onto the stack carried by the elevator. Simultaneously, the central single feed stack is also carried by a separate elevator which indexes upwardly by the thickness of each workpiece which is removed by the differentiating heads.

Photocells positioned on opposite sides of the single feed stack detect whether the underside of each ply is light or dark colored to determine if it is properly a left or a right facing ply. Photocell detectors are also used to control the height of the stacks on the feed and receiving elevators.

It is therefore an object of the present invention to provide apparatus for sequentially separating alternate layers of web-like workpieces from a single stack into a plurality of stacks.

It is still another object of the invention to provide a fabric ply separator which automatically detects whether the separated fabric plies are face-up or face-down.

It is still a further object of the invention to provide an apparatus for sequentially separating alternate layers of fabric workpieces from a single stack while simultaneously not causing the separated workpiece or the remainder of the stack to become misaligned.

The foregoing and other objectives, features and advantages of the invention will be more readily understood upon consideration of the following detailed description of certain preferred embodiments of the invention, taken in conjunction with the accompanying drawings.

BRIEF DESCRIPTION OF THE DRAWINGS

FIG. 1 is a perspective view of a separating apparatus according to the invention;

FIG. 2 is a diagrammatic illustration for use in explaining the operation of the embodiment depicted in FIG. 1;

FIG. 3 is an enlarged, vertical, front view of the single stack feed elevator of the embodiment depicted in FIG. 1, with portions broken away and in section;

FIG. 4 is an enlarged, plan view of the elevator depicted in FIG. 3 and with portions broken away and in section;

FIG. 5 is an enlarged, vertical, side view of the elevator depicted in FIG. 3 with portions broken away, and in section;

DETAILED DESCRIPTION OF THE PREFERRED EMBODIMENTS

Figure 6:
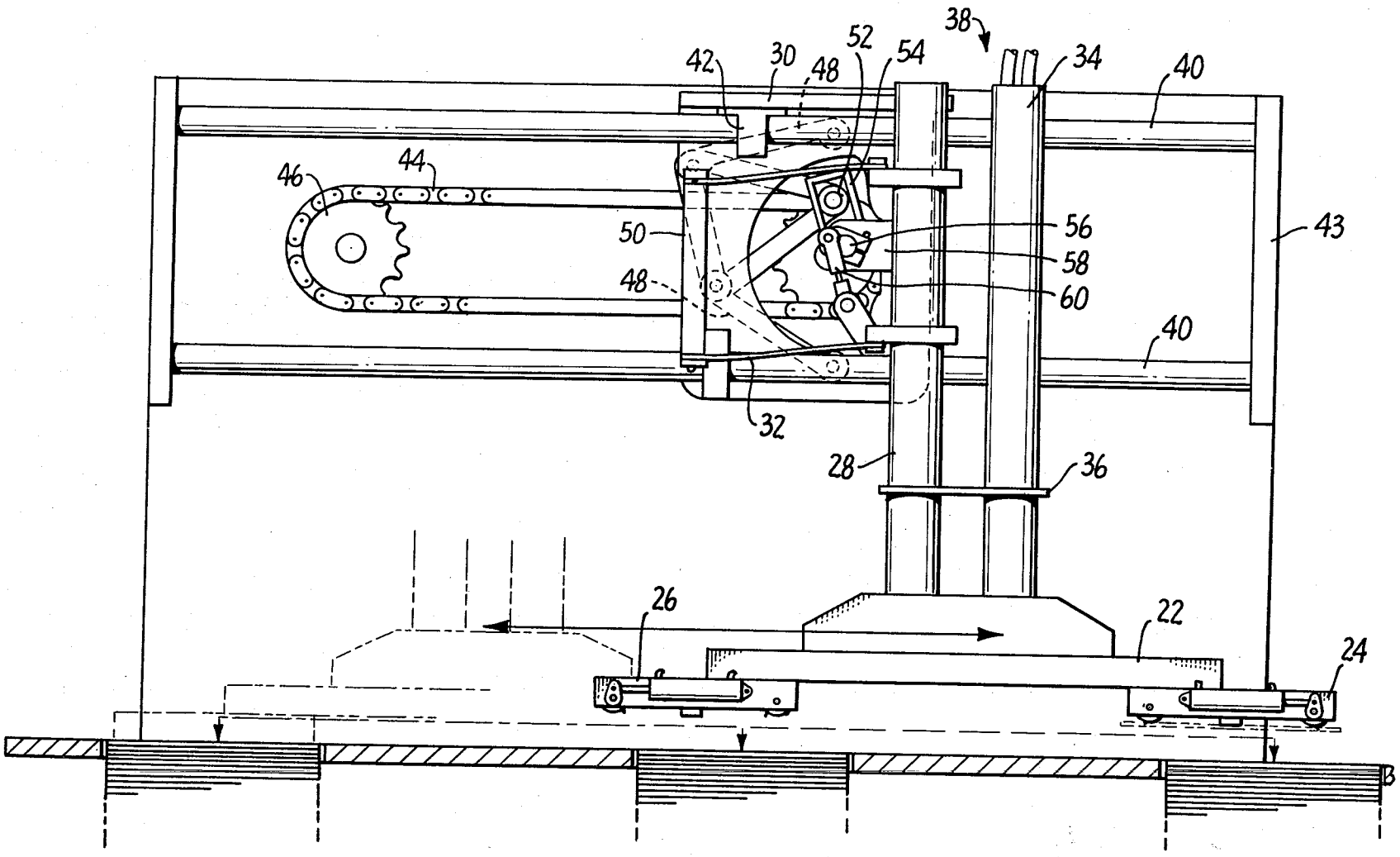
FIG. 6 is an enlarged, front view of the carriage transfer mechanism of the embodiment depicted in FIG. 1, with portions broken away and in section.

This application is directed specifically to the embodiment depicted in FIGS. 15A–15F; the remaining embodiments being the subject of the applicant's copending application Ser. No. 807,348, now U.S. Pat. No. 4,143,871 issued Mar. 13, 1979. For the purpose of illustrating the entire setting of this embodiment, however, the complete apparatus is described hereinafter, together with some of the other modified embodiments.

Referring now more particularly to FIG. 1, the single feed stack of alternating facing fabric workpieces 10 (shown in dashed-line fashion for clarity of illustration) is carried by a single feed elevator 12 mounted for vertical movement in a frame 14. The details of the elevator mechanism 12 will be described further in a subsequent portion of this application. On the left and right sides of the feed elevator 12 are positioned additional vertical elevators 16 and 18, respectively. The elevators 16 and 18 are also mounted in the frame 14 for vertical movement. Whereas the elevator 12 is mechanized to make upward adjustments as the layers of garment workpieces 20 are removed from the stack 10, the elevators 16 and 18 are mechanized to index downwardly by a distance corresponding to the thickness of one workpiece. The actions of the elevators 12, 16 and 18 will be described in greater detail hereinafter.

Figure 7:
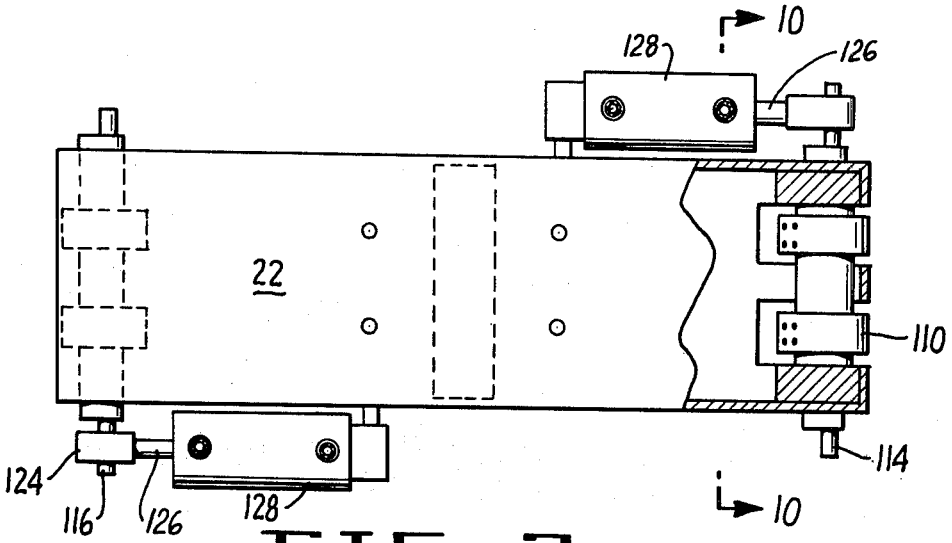
FIG. 7 is a plan view, with portions broken away and in section of a differentiating head according to the invention.

Positioned above the elevators 12, 16 and 18 is the differentiating mechanism comprised of a horizontal bar 22 which carries separate differentiating heads 24 and 26 at its right and left ends, respectively. The differentiating heads 24 and 26 are each capable of removing the topmost workpiece 20 from the stack 10 without disturbing the remaining portion of the stack 10. The manner in which this is done will be described in greater detail at a later portion in this application with particular reference to FIG. 7.

The horizontal bar 22 is carried on the lower end of a vertical pipe 28 which is flexibly attached to a horizontally movable carriage 30 by means of a pair of flexible horizontal straps 32. A second, vertical, hollow pipe 34 is also attached to the horizontal bar 22 by means of a bracket 36 which is also attached to the first vertical pipe 28. The pipe 34 can be connected to a vacuum source (not shown) in some embodiments or it can simply serve as a conduit for air lines 38 which activate the differentiating heads.

The carriage 30 travels on a pair of vertically spaced apart horizontal, parallel rails 40 mounted in a frame 43 over the area where the stacks of fabric workpieces are located. The carriage slides on the rails 40 by means of sleeve bearings 42 and roller wheels (not shown). A motor driven sprocket chain 44 trained around sprocket gear wheels 46 at opposite ends of the rails 40 provides the moving force for reciprocating the carriage 30 back and forth on the rails 40. The carriage 30 is attached to the drive chain 44 by means of a pair of links 48 pivoted at one end to the top and bottom of the carriage 30 and at their other ends to separate vertices of a triangular member 50. The third vertex of the triangular member 50 is rotatably attached to the sprocket chain 44. In this way, no non-tensional forces are imparted to the drive chain 44 or to the sleeve bearings 42 of the carriage 30. A roller 52 projects outwardly from the vertex of the triangular member 50 at the point where it attaches to the sprocket chain 44 and is captured by a rectangular bracket 54. The rectangular bracket 54 is mounted on one end of a shaft 56 which is rotatably mounted in a boss 58 attached to the carriage 30.

At the opposite end of the shaft 56 a crank mechanism is mounted. The crank mechanism 60 is attached to the vertical pipe 28 to raise and lower the vertical pipe 28, and hence the differentiating heads 24 and 26, each time the roller 52 passes around the ends of the sprocket gears 46. The manner in which this carriage transfer mechanism operates is explained in greater detail in the applicant's co-pending patent application entitled Intermittent Drive and Transfer Assembly, filed Feb. 2, 1976 and assigned Ser. No. 654,705, now U.S. Pat. No. 4,133,217.

The sprocket gears 46 are spaced apart by a distance corresponding roughly to the distance between the central feed stack and one of the receiving, separated ply stacks. The length of the horizontal arm 22 is also equal to the distance between the central feed stack 10 and one of the separated ply stacks. In this way, as best viewed in FIG. 6 in hidden-line fashion, when the carriage 30 is at the extreme right hand end of travel as viewed in FIG. 6, the differentiating head 24 will be positioned over the receiving elevator 18 and the differentiating head 26 will be positioned over the central feed stack elevator 12. At the extreme left hand end of the travel of the carriage 30, as viewed in FIG. 6, the differentiating head 26 will be positioned over the receiving elevator 16 and the differentiating head 24 will be positioned over the central feed stack elevator 12. As will be explained in greater detail hereinafter, the differentiating heads 24 and 26 are operated to engage the topmost workpiece 20 of the central feed stack 10 on the elevator 12 at the same time that the other differentiating head, positioned over one of the receiving elevators 16 or 18, is releasing a previously differentiated workpiece.

Referring now more particularly to FIG. 3, the apparatus for raising and lowering the stack elevators will be described in greater detail. In the following description, only the single stack feed elevator 12 will be described, however, it should be understood that this description is equally applicable to the elevators 16 and 18 except that whereas the elevator 12 is indexed upwardly by the thickness of each layer which is differentiated, the elevators 16 and 18 are indexed downwardly for each differentiated layer which is placed on top of the stack.

The elevator 12 has a leg 62 which is a horizontal platform for carrying the single feed stack and a vertical portion 64 integral therewith, which has an annular slide bearing 66 for slidably mounting the elevator 12 on a vertically extending rod 67 mounted in the frame 14. The elevator platform 12 is prevented from rotating in a horizontal plane by a pair of rollers 68 which straddle a vertically extending rail 70 spaced behind the rod 67, as viewed in FIG. 4. The rollers 68 are attached to the vertically extending portion 64 of the elevator 12 by means of an integrally mounted boss 72 on the vertical portion 64.

The elevator platform 12 is raised and lowered by means of a vertically extending sprocket chain 74 which is trained around a sprocket pulley 76 mounted on a horizontal shaft 78 at the base of the elevator and around a sprocket 80 rotatably mounted on a horizontal shaft 82 at the top of the elevator. The horizontal shafts 78 and 82 are rotatably mounted in bosses or brackets attached to the frame 14. The lower sprocket pulley 76 also has a drive chain 84 trained around it which is driven by an electric motor 86. It is to be understood that the motor 86 includes suitable reduction gearing (not shown). The lower sprocket pulley 76 is not pinned to the shaft 78 and rotates freely about it. It is to be understood that each of the elevators 12, 16 and 18, has an independent motor drive.

In order to completely stabilize the platform 12 in the horizontal plane, a pair of vertically extending rods 88 and 90 are positioned on either side of the elevator platform near the front, as best viewed in FIG. 4. The vertical rod 90 is on the right side of the platform and the vertical rod 88 is on the left side of the platform as viewed in FIG. 4. Separate rollers 92 and 94 mounted on the underside of the horizontal portion 62 of the elevator bear against the rods 88 and 90, respectively. The vertical rod 88 is mounted on a horizontal swinging arm 96 which is pivoted on the frame 14 toward the rear of the horizontal platform 62 at a point 98. This allows the vertical rod 88 to be swung open from the platform elevator 12 when the feed stack is placed on top of the platform 62. The rod 88 is thereafter swung closed to prevent the stack from being removed from the elevator 12.

The frame 14 includes a top horizontal working space 100 which has a cut-out portion 102 to accommodate the horizontal platform 62 of the elevator 12. It has similar cut-out portions to accommodate the other elevators as well. A pair of photo-optic sensors 104 are placed on opposite sides of the cut-out space 102 to detect the presence or absence of the top layer of material in the stack carried by the elevator 12. These photo-optic sensors lead to a control panel (not shown) which control the indexing motion of the motor 86 which raises the elevator 12 by a distance corresponding to the thickness of one ply of fabric in the stack as it is removed by the differentiating heads. A second pair of photo-optic sensors 106 are mounted on top of the horizontal platform 100 of the frame 14 and are directed upwardly to detect the contrast of the underside of the fabric workpieces carried by the differentiating heads 24 and 26. This contrast is due to the fact that the twill denim fabric from which the pocket facings are made, has a blue tint on the one side and a white line striped pattern on the opposite side. The white striped side reflects more light and thus can be sensed by the sensors 106. The sensors 106 additionally provide information as to whether or not a pocket facing has been dropped by one of the differentiating heads which also would throw off the sequencing of the differentiation process.

The controls for the operation of the carriage transfer 30 and the control for the differentiating heads 24 and 26 will not be described in detail since such sequential controls are well known to those skilled in the art. They basically involve a timing disc mounted to rotate in synchronism with the drive for the carriage transfer. The timing disc includes sensor means for actuating pneumatic valves and the drive motors in a properly timed sequence.

Referring now more particularly to FIGS. 1, 2 and 7–9, the operation of the differentiating heads will be described. Although the description relates particularly to the differentiating head 26, it will be understood that the description is equally applicable to the differentiating head 24.

Figure 10:
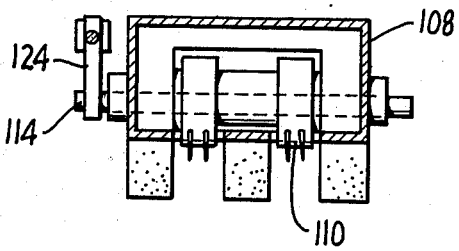
FIG. 10 is a vertical sectional view taken generally along the lines 10—10 of FIG. 7.

The differentiating head 26 includes a pair of spaced apart rectangular, horizontal frame members 108 and 109 mounted on the horizontal bar 22. Separate groups of cylindrical elements 110 and 112 are rotatably mounted on the frame members 108 and 109, respectively. The cylindrical elements are eccentrically mounted to rotate with shafts 114 and 116, respectively. The shaft 114 is more or less centered through the lower right hand quadrant, as viewed in FIG. 7, of the circular cross-section of the cylindrical elements 110. The shaft 116 is more or less centered through the lower left hand quadrant of the cross-section of the cylindrical elements 112. The cylindrical elements 110 and 112 as well as the shafts 114 and 116 are all parallel to each other. The frames 108 and 109 are adjustably mounted on the bar 22 by brackets 111 so that the cylindrical elements 110 and 112 can be spaced apart by slightly less than the width of any given group of fabric workpieces 10. As best viewed in FIG. 10, the cylindrical elements 110 are adjustably spaced apart along the shaft 114 and the elements 112 are adjustably spaced apart along the shaft 116.

Figure 8:
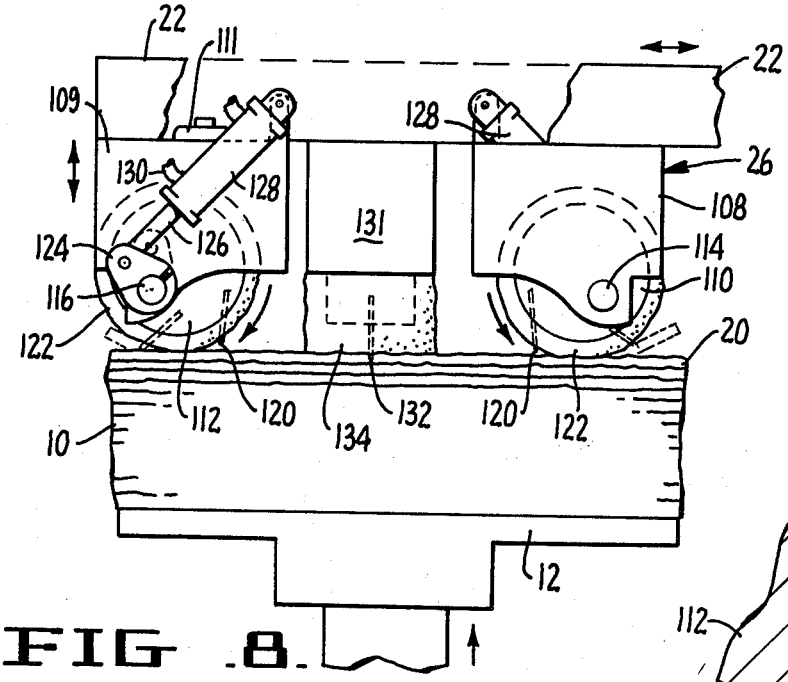
FIG. 8 is an enlarged, vertical view of a differentiating head according to the invention.
Figure 9:
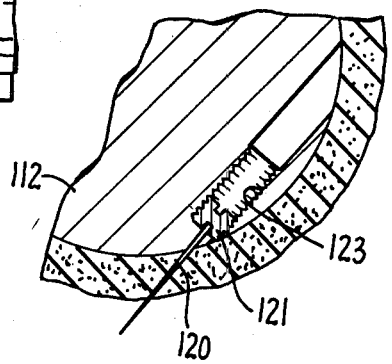
FIG. 9 is an enlarged, vertical, sectional view, with portions broken away, of one of the differentiating cylinders of the differentiating head depicted in FIG. 8.

Each cylindrical element 110 and 112 has at least a pair of needles 120 threadably mounted in the cylinder so as to project slightly beyond the cylindrical surface of the cylinders and at an acute angle to the cylindrical surface (see FIG. 8). The needles 120 are each mounted in a threaded screw 121 which is screwed into a threaded bore 123. The needles of the cylinder 110 are mounted so as to be inclined to the cylindrical surface taken in the counterclockwise direction. The needles of the cylinder 112 are mounted so as to be inclined to the cylindrical surface in the clockwise direction. Thus, the needles of the cylinders 110 and 112 are directed towards the ends of the topmost fabric layer 20.

Each cylinder 110 and 112 has an outer cylindrical layer of foam 122 through which the needles 120 project by a distance which is adjusted to be slightly less than the thickness of one layer of fabric in the stack 10. In this manner, when the horizontal arm 22 with the differentiating head 26 is lowered onto the top of the stack 10 of the fabric layers, the needles 120 will penetrate only into the top layer 20 of fabric. In order to counter-rotate the cylinders 110 and 112, with respect to each other, the shaft 116 of the cylinder 112 is provided with a crank arm 124 which is pivotally connected to the shaft 126 of a pneumatic actuator 128. Upon the application of a proper pressure differential to the actuator 128 by means of air hoses 130, the shaft 126 may be made to withdraw into the cylinder 128 or extend from it. When it is withdrawn into the actuator 128, the reaction is to rotate the cylinder 112 in a clockwise direction, as indicated in dash-line fashion in FIG. 7. A similar actuator is disposed on the opposite side of frame 108 to operate the shaft 114 and thus simultaneously rotate the cylinder 110 in the opposite direction from the direction of rotation of the cylinder 112.

Between the frames 108 and 109, a second needle 132 is mounted in a downwardly extending portion 131 of the frame so as to project beneath the frame and normal to a hypothetical plane lying tangent to the corresponding portions of the curved surfaces of the cylinders 110 and 112. A block of foam 134 surrounds the needle 132.

The adjustability of the spacing between the cylindrical elements, such as the elements 110, along their axis of rotation allows workpieces of different shapes and sizes to be accommodated.

In operation, the differentiating head 26 is lowered by means of the carriage transfer mechanism, as described in greater detail above, onto the top layer 20 of the stack 10 of fabric pieces on the elevator 12. The foam 122 on the cylinders 110 and 112 as well as the foam block 134 are slightly compressed and the pneumatic actuator 128 and its corresponding counterpart on the opposite side of the frame, 108, are actuated to counter-rotate the cylinders 110 and 112 so as to drive the needles 120 into the topmost fabric layer. Because of the eccentric mounting of the cylinders 110 and 112 on the shafts 114 and 116 a more favorable orbit of motion for the needles is thereby obtained than if the cylinders were centrally mounted. This eccentric needle movement gives a more favorable angle of penetration, i.e., nearly perpendicular to the top layer 20 by the needle 120. The needle 120 is also swung with less vertical displacement when it is nearly parallel with the stack layers thereby providing a hooking action.

Because of the location of the cylinders 110 and 112, being adjusted to be close to the edges of the fabric layer 118, the counter-rotation of the cylinders tends to curl up the edges of the topmost layer, thereby breaking the bond of interlocking threads which would otherwise hold it to the next most fabric layer. The effect is a stretching of the topmost layer in addition to curling the edges. The purpose of the stationary needle 132 is to prevent any misalignment of the topmost fabric layer as it is being differentiated. Once the interlocking thread bond is broken by the action of the needles, 120, the differentiating head 24 is raised to carry away the topmost layer. After the differentiating head is positioned and lowered onto the stack on the appropriate receiving elevator 16, the actuators, such as actuator 128, are operated in the reverse direction to extend their shafts 126, thereby counter-rotating the cylinders 110 and 112 in the reverse direction from the previous operation to thereby withdraw the needles 120 from the topmost layer 20 of fabric and release it. At this point, the resiliency of the foam layers 122 and 134 aids in separating the fabric from the needles and releases the topmost layer 20 onto the top of the stack carried by the elevator 16. As mentioned previously, upon the removal of the topmost layer 20 from the stack 10 carried by the elevator 12, the photo cells 104 will cause the stack to index upwardly by a distance equal to approximately the thickness of one layer of the fabric. The photo cells 104 which control the positioning of the elevator 16 will cause the elevator to index downwardly by the distance approximately equal to the newly deposited topmost layer 20 released by the differentiating head 26.

The control of the differentiating head actuators 128 is done by the timing disc mechanism referred to above (but not shown). It should be understood that in other embodiments other types of controls may be used, such as contacting switches and photo-optic sensors.

Figure 11:
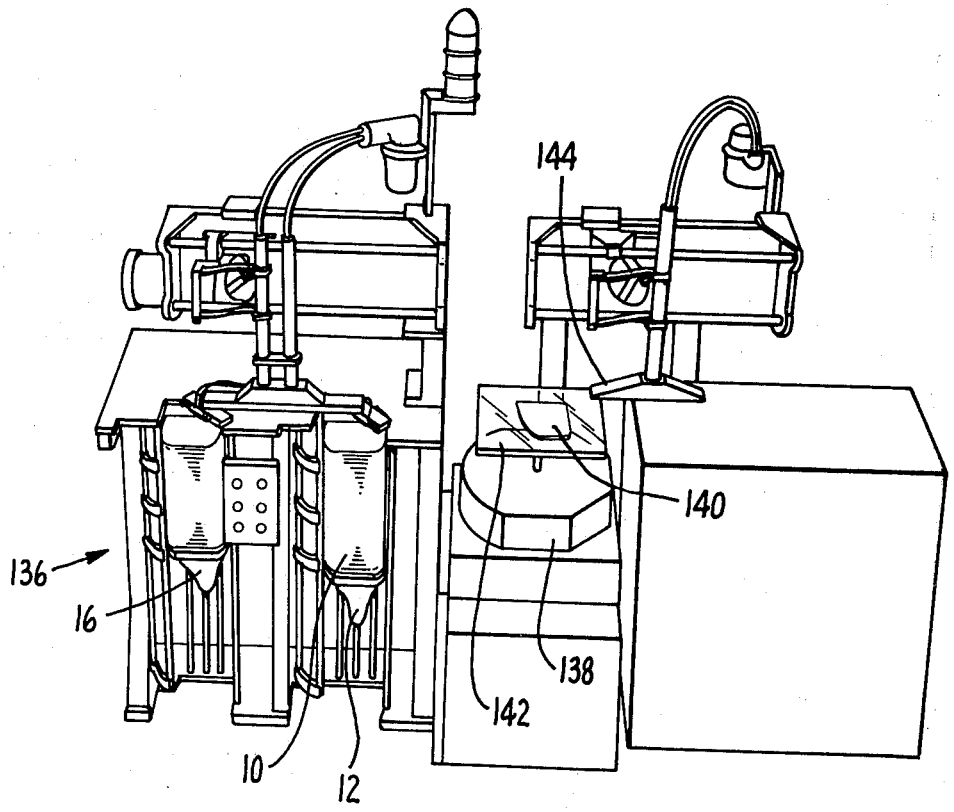
FIG. 11 is a perspective view of the separating apparatus of the invention used in conjunction with other garment fabricating apparatus.

Referring now more particularly to FIG. 11, the facing ply separator of the invention when used in conjunction with an assembly line garment manufacturing system is illustrated. In this application, the facing ply separator is used to feed alternately facing plies to the input assembly line system as well as providing a stack of plies all of which are of one type. This is in contrast to the apparatus described above in reference to FIG. 1 in which the single main feed stack was divided into two separate stacks of same type plies. As shown in FIG. 11, the facing ply separator apparatus 136 of the type described above, differentiates the topmost layer of the main feed stack 10 and sequentially and alternately places the differentiated topmost layer onto the stack carried by the receiving elevators 16 and onto a registration table 142. The registration table 142 is, in effect, a transparent glass, horizontal plane carried by a servo mechanism 138. Stationary photo-optic sensors (not shown) control the servo mechanism 138 to position the table 142 such that the workpiece 140 deposited by the facing ply separator 136 onto the table 142 is precisely positioned with respect to a vacuum transfer mechanism 144. The transfer mechanism 144 then reciprocates horizontally to place the separated piece 140 at one input to the assembly line apparatus, the remainder of which is not shown in FIG. 11. The registration table 138 and the carriage transfer mechanism 144 are not described in detail since such mechanisms are generally well known. See, for example, U.S. Pat. Nos. 3,548,196 and 3,442,505. By this manner of placing one ply into a separate stack and the other ply onto the feeding means of a processing machine directly restacking of the one half of the separated material is thereby avoided.

Referring now more particularly to FIGS. 12A–12H, inclusive, a modification of the differentiating head depicted in FIGS. 7–10 is illustrated. Similar elements have been assigned corresponding reference numerals, primed. The basic differentiating head depicted in the modified embodiment is essentially the same as that depicted in FIGS. 8–10, with the exception of the center needle 132'. The center needle 132' is for the purpose of fixing the position of the topmost layer 20 with respect to the rotatable cylinders 110' and 112' during the separation process, thereby preventing any misalignment of the topmost layer 20 either during separation or during its release upon the separated workpiece piles.

The center needle 132' in the modified embodiment is mounted on the end of a shaft 202 which projects from a vertical arm 200. The arm 200 may be attached to the frame 22 (see FIG. 8) or it may be independently mounted. In any case, the arm 200 is raised and lowered simultaneously with the rotatable cylinders 110' and 112' during the separation process. A stripper 204 is coaxially mounted about the shaft 202 and is slidable on the shaft 202 between a first position in which the needle 132' is unsheathed so that it can penetrate the topmost layer 20 and a second position, shown in FIG. 12H, in which the needle 132 is covered by the lower end of the stripper 204. The action of the stripper 204 may be either by simple gravity and inertia or it may be air cylinder actuated or spring loaded.

Figure 12A:
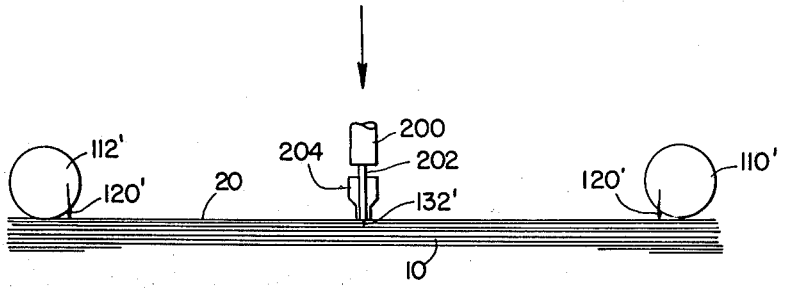
FIGS. 12A–12H, inclusive, are diagrammatic illustrations of a second embodiment of the invention and its method of operation.
Figure 12B:
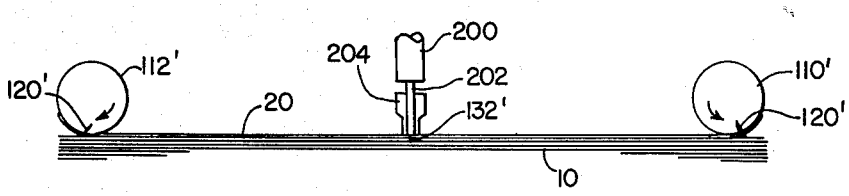
Figure 12C:
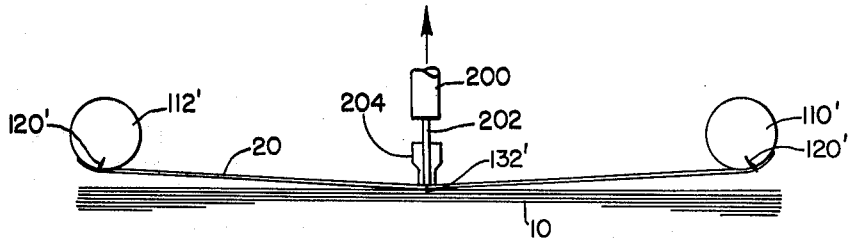
Figure 12D:
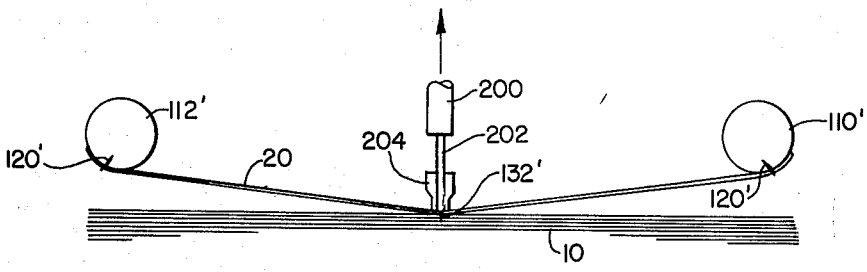

The operation of this modified embodiment is depicted in the sequence of drawings in FIGS. 12A–12H. In FIG. 12A, the differentiating head has been lowered onto the topmost layer 20 and the needle 132' has penetrated the topmost layer 20 and the stripper 204 has been lifted to its uppermost position by the force of the fabric 20 against the lower edge of the stripper 204. In FIGS. 12B and 12C, the rotatable cylinders 110' and 112' have been counter-rotated to engage the topmost layer 20 and to curl its outer edges up and away from the corresponding edges of the next succeeding layer in the stack 10. The rotatable cylinders 110' and 112' are lifted upwardly with respect to the arm 200 which causes the topmost layer 20 to bend around the projecting needle 132', thereby further aiding the separation of the topmost layer 20 as best shown in FIG. 12D.

Figure 12E:
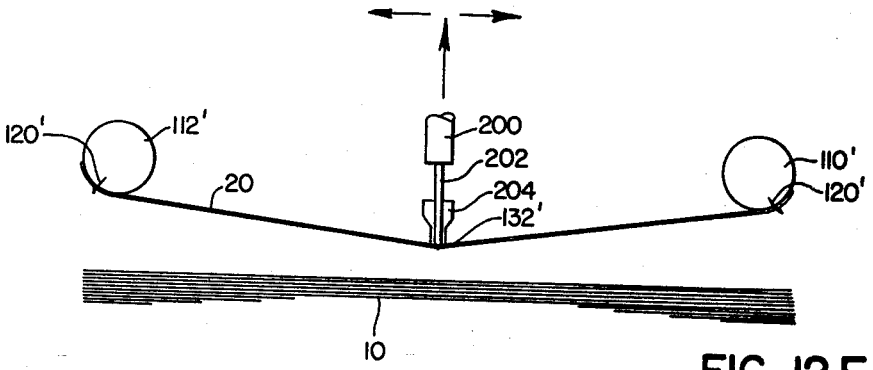

In FIG. 12E the differentiating head has separated the topmost layer 20 and moves it to either the first or the second location in the manner described above for the primary embodiment.

Figure 12F:
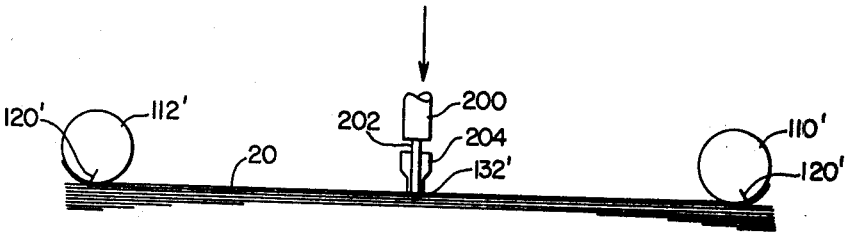
Figure 12G:
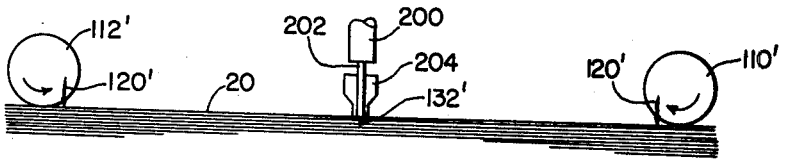
Figure 12H:
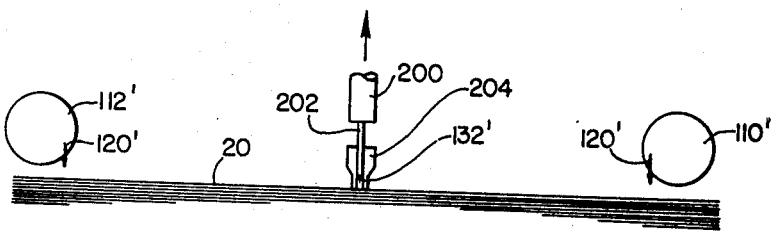

In FIG. 12F, the differentiating head has deposited the topmost layer 20 onto one of the receiving elevators 16 or 18 and is about to disengage the rotatable cylinders 110' and 112'. The disengagement of the rotatable cylinders 110' and 112' is accomplished by counter-rotation as is shown in FIG. 12G. The differentiating head is then lifted clear of the receiving elevator and the inertia of the stripper 204 causes it to slide to its lowermost position on the shaft 202 thereby forcing the topmost layer 20 clear of the needle 132' to complete the differentiation process.

It should be apparent that in other embodiments the stripper 204 may be stationary with respect to the arm 200 and the shaft 202 may be withdrawable up into the arm 200. It is the sheathing and unsheathing of the needle 132' which the applicant regards as his invention.

Figure 13A:
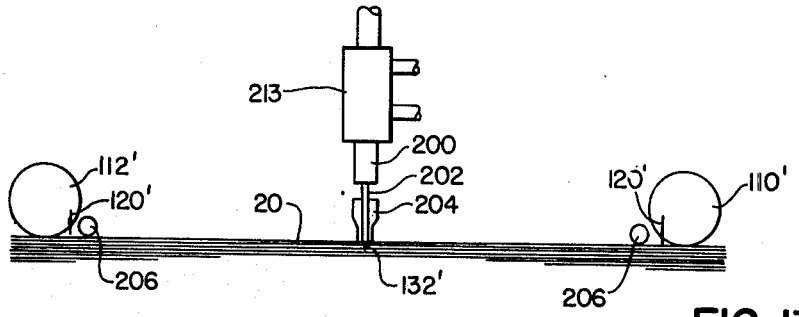
FIGS. 13A–13G, inclusive, are diagrammatic illustrations of a third embodiment of the invention and its method of operation.
Figure 13B:
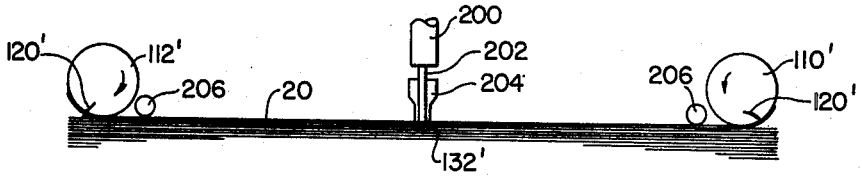
Figure 13C:
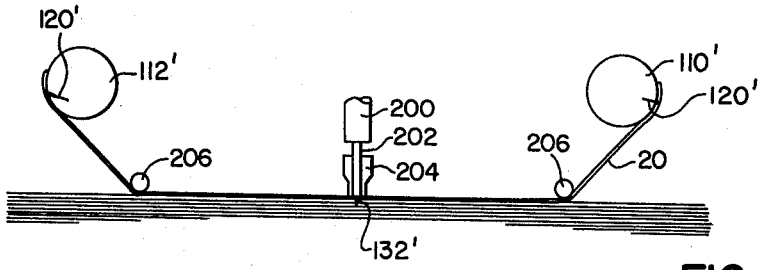
Figure 13D:
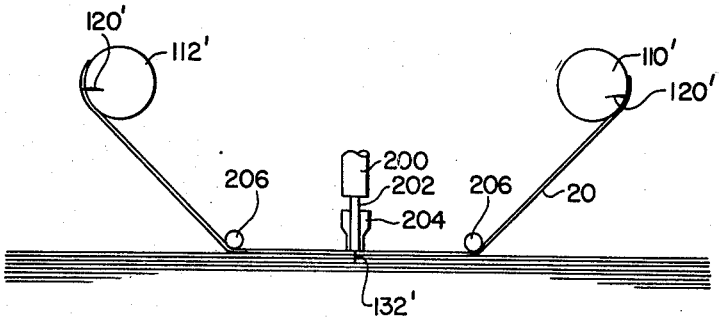
Figure 13E:
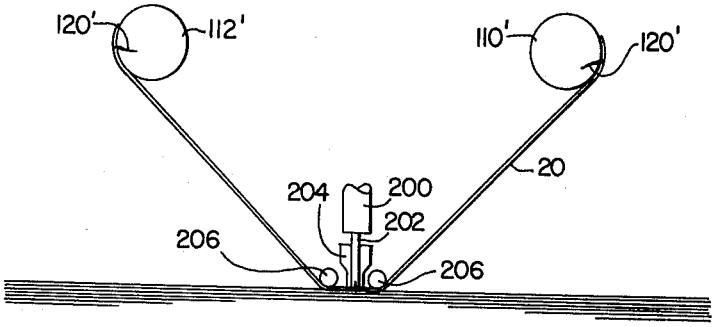

Referring now more particularly to FIGS. 13A–13F, still a further modification of the embodiment depicted in FIGS. 12A–12H is illustrated. In this embodiment, the differentiation of the topmost layer is aided by a pair of separating rods 206. The separating rods 206 are mounted parallel to the rotatable cylinders 110' and 112'. The rods 206 can be supported by a lever arm or simply can extend through horizontal slots 208 in a pair of horizontal members 210 positioned at opposite ends of the cylinders 110' and 112' so as to straddle the cylinders, as best shown in FIG. 13G. The frame members 210 are attached to the differentiating head frame 22. Thus, the separating rods 206 are slidable horizontally in the slots 208 in a plane which is parallel to the topmost workpiece 20. The separating rods 206 are biased toward their outermost positions, as best shown in FIG. 13G, by tension springs 212 which are attached to the frame members 210.

A further difference from the embodiment depicted in FIGS. 12A–12H is that the rotatable cylinders 110' and 112' are movable vertically somewhat independently of the center needle 132'. To accomplish this, the vertical rod 200 which carries the needle 132' forms the end of a plunger in a hydraulic or pneumatic actuator 213 which, in turn, is attached to the frame 22 of the differentiating head. The operation of this modified embodiment is best depicted in FIGS. 13A–13F. The differentiating head is first lowered onto the topmost layer 20 of the feed stack as viewed in FIG. 13A. The rotatable cylinders 110' and 112' are then counter-rotated to engage the needles 120' in the workpiece 20. The differentiating head is then raised vertically slightly while the actuator 213 is caused to extend the needle 132' downwardly so as to remain in contact with the layer 20 on top of the stack 10. Simultaneously with the raising of the rotatable cylinders 110' and 112', the workpiece 20 is caused to bend around the separating rods 206 and to thereby exert a force inwardly towards the needle 132' on the rods 206. As this process continues, the rods 206 are drawn toward the center of the workpiece 20 and the needle 132', as best shown in FIGS. 13D and 13E. All during this time, the actuator 213 causes the needle 132' to press the center of the workpiece 20 against the topmost layer of the stack 10.

Figure 13F:
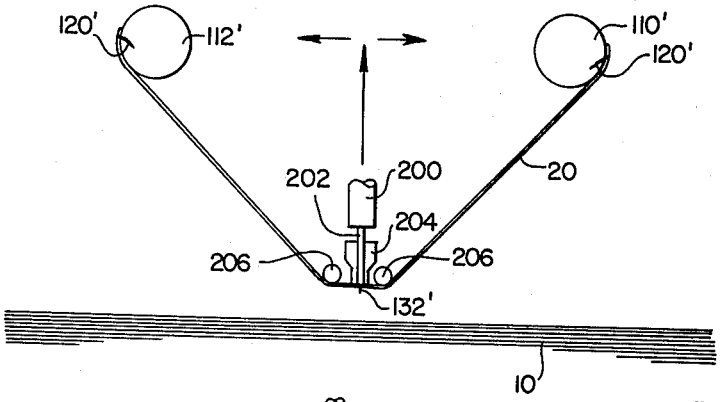
Figure 13G:
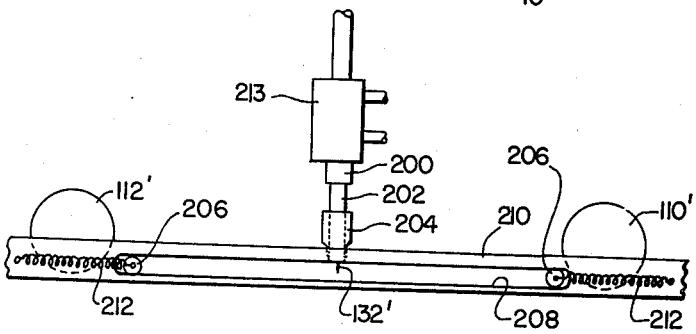

Ultimately, the differentiating head lifts the cylinders 110' and 112' together with the center needle assembly 132' and the workpiece 20 free of the stack 10 as shown in FIG. 13F.

The differentiating head releases the separated workpiece 20 on one of the receiving elevators 16 or 18 by simply reversing the above described process. As in the embodiments depicted in FIGS. 12A–12H, when the needle 132' is withdrawn from the topmost workpiece 20 after its release the stripping member 204, either by inertia or by spring force, strips the workpiece 20 from the end of the needle 132' to aid in the separation.

Figure 14A:
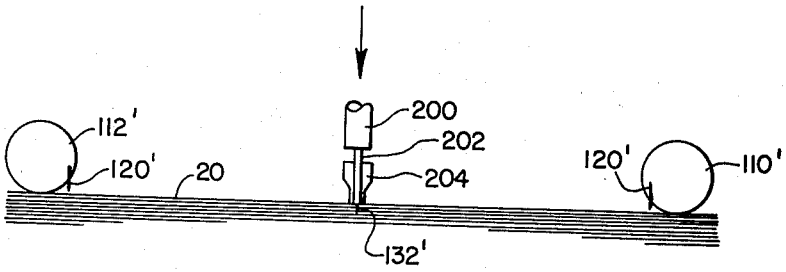
FIGS. 14A–14F, inclusive, are diagrammatic illustrations of a fourth embodiment of the invention and its method of operation.
Figure 14B:
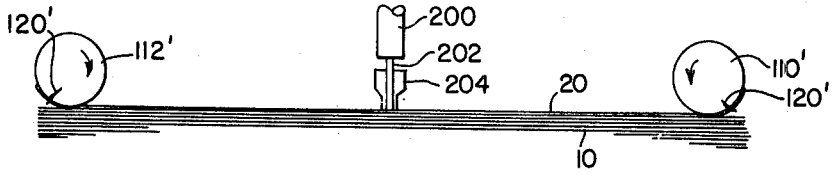
Figure 14C:
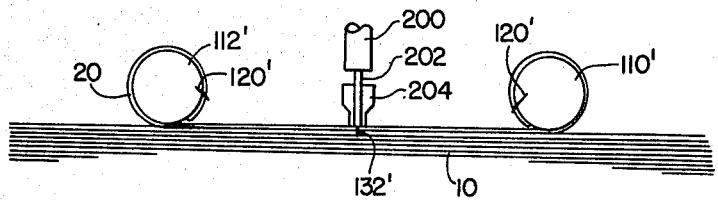
Figure 14D:
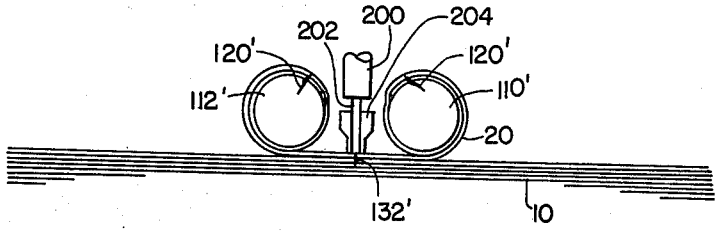
Figure 14E:
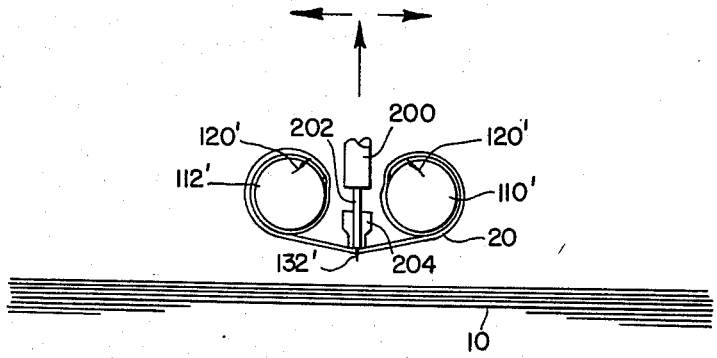
Figure 14F:
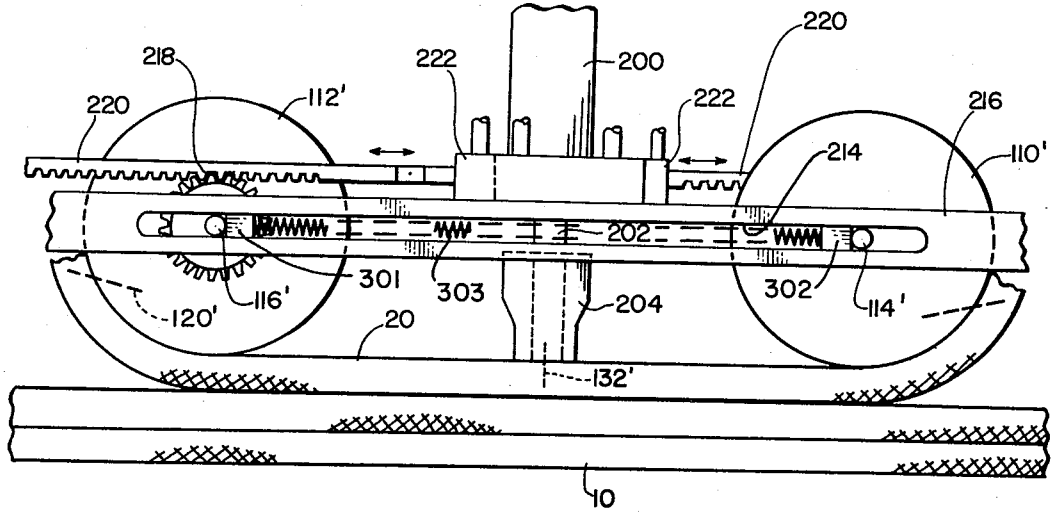

Referring now more particularly to FIGS. 14A–14F, still another variation of the embodiment depicted in FIGS. 12A–12H is illustrated. The primary difference between this embodiment and the embodiment depicted in FIGS. 12A–12H is that the rotatable cylindrical elements 110' and 112' not only are counter-rotated to engage or disengage the topmost workpiece 20, but they are simultaneously moved closer or further away from each other during engagement and disengagement with the workpiece 20, respectively. Thus, as best shown in FIGS. 14B–14E, after the differentiating head is lowered onto the topmost workpiece 20 the cylinders 110' and 112' are counter-rotated to engage the needles 120' in the topmost workpiece 20 while at the same time the cylinders are rolled closer to each other toward the center of the workpiece 20 at the needle 132'. When the cylinders 110' and 112' have reached a predetermined spacing immediately adjacent to the needle 132', the differentiating head lifts up with the workpiece 20 having its opposite ends rolled around the cylinders 110' and 112'. The mechanism by which the cylinders 110' and 112' are moved and simultaneously rotated is illustrated in FIG. 14F. It should be understood that this is simply an example of one suitable mechanism for moving and rotating the cylinders and numerous other types of mechanisms will undoubtedly be apparent to those having ordinary skills in the art. It is the type of movement of the cylinders 110' and 112' which the applicant regards as his invention rather than the specific mechanism for carrying out this movement.

As shown in FIG. 14F, the cylinders 110' and 112' are mounted on symmetric, axial shafts 114' and 116', respectively. It will be noted that the shafts 114' and 116' are not mounted in the cylinders 110' and 112' eccentrically as is disclosed in the primary embodiment. A modification to allow an eccentric rotatable mounting would be apparent to those skilled in the art, however, it will be omitted for the sake of clarity in this description. The shafts 114' and 116' are carried in a horizontal slot 214 in a horizontal frame member 216 which is attached to the differentiating head 22. It will be appreciated that a frame member 216 is positioned at each end of the shafts 114' and 116' in order to support the cylinders 110' and 112'.

A gear 218 is mounted at one end of each of the shafts 114' and 116'. Each gear 218 engages a separate rack member 220 which is attached to the end of a plunger of a separate pneumatic actuator 222 mounted on one of the frame members 216. The pneumatic actuators 222 are two-way acting. When they are caused to retract, the rack members 220 move toward the center of the workpiece 20, that is toward the member 200 which is centered between the cylinders 110' and 112'. The actuators 222 are simultaneously operated to thereby simultaneously counterrotate the cylinders 110' and 112' and roll them towards each other. The compression spring 303 provides a force onto sliding plungers 301 and 302 which in turn force the centers 114' and 116' apart. This force is counteracted by the workpiece 20, thus providing tensioning to desired levels. The spring 303 can be replaced by pneumatic cylinders in other embodiments. In order to disengage the cylinders 110' and 112' from the workpiece 20, of course, the actuators 220 are operated to extend their rack members 220 and thereby counter-rotate the cylinders 110' and 112' away from each other. As mentioned above, it will be apparent that numerous other modifications for accomplishing the same objective will be readily apparent to those skilled in the art and the applicant makes no claim of invention to the particular mechanism for carrying out this operation.

The cylinders 110' and 112' shown in FIG. 14F are of exaggerated size for aid in the illustration. In actual practice, the cylinders 110' and 112' would be of a relatively small diameter to allow the workpiece 20 to be rolled thereon.

Referring now more particularly to FIGS. 15A–15F, still another embodiment of the invention is illustrated. Heretofore, the differentiating head was moved by a transfer carriage mechanism in order to sort the differentiated workpieces into two separate piles. In the next series of embodiments, including the embodiment depicted in FIGS. 15A–15F, the differentiating head remains in relatively close proximity to the feed stack 10. The separated workpieces are transferred sequentially to the first and second locations by means of a conveyor type belt. Such a belt may have a gripper thereon or may be a vacuum operated belt of the type which is well known to those skilled in the making of automated, garment manufacturing devices.

In this embodiment, the differentiating head has a single rotatable cylindrical element 224 having a projecting needle 120'. The cylindrical element 224 is positioned at one edge of the fabric ply stack 10. A separating rod 226 is located immediately adjacent to the cylinder 224 on the side opposite to the edge. During separation the cylindrical element 224 is rotated, as for example, in a clockwise direction shown in FIG. 15B to engage the needle 120' in the edge of the topmost fabric workpiece 20. This curls up the edge of the workpiece 20. A clamp 228 is rotated in a clockwise direction to hold down the remaining edges of the feed stack 10.

Figure 15A:
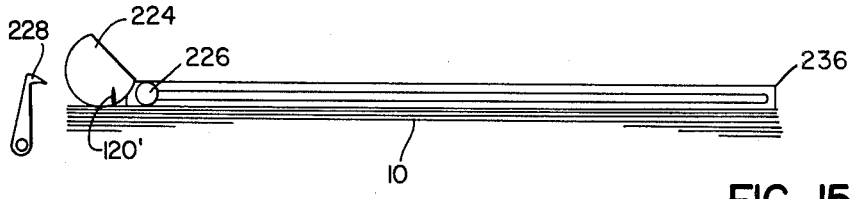
FIGS. 15A–15F, inclusive, are diagrammatic illustrations of a fifth embodiment of the invention and its method of operation.
Figure 15B:
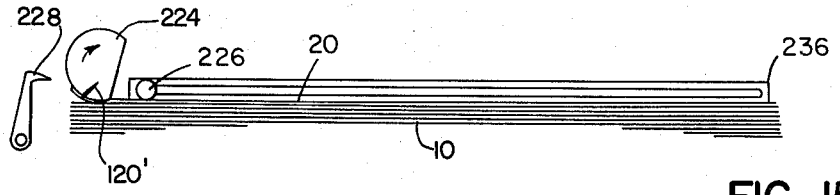
Figure 15C:
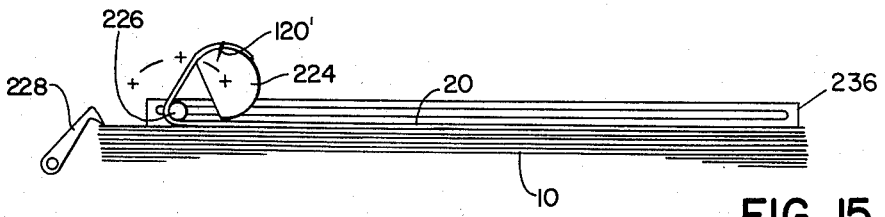
Figure 15D:
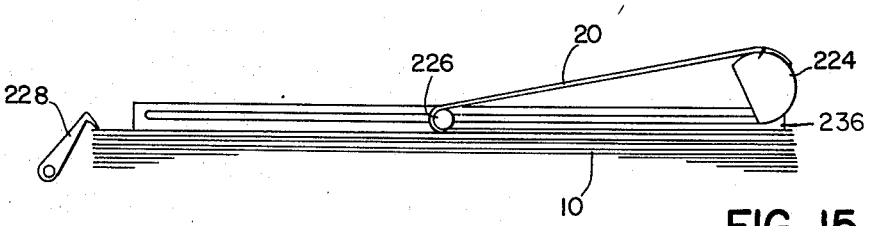
Figure 15E:
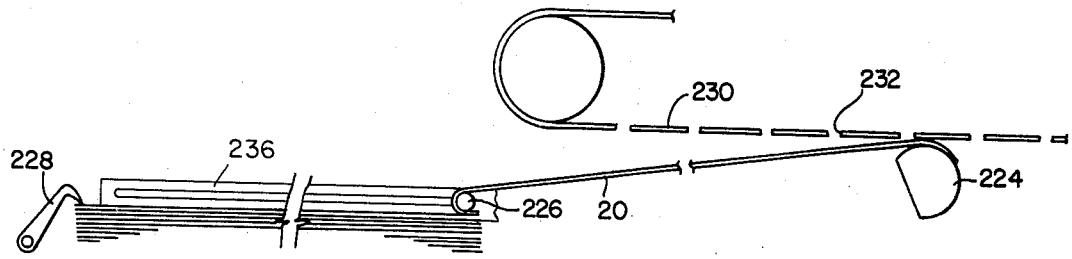
Figure 15F:
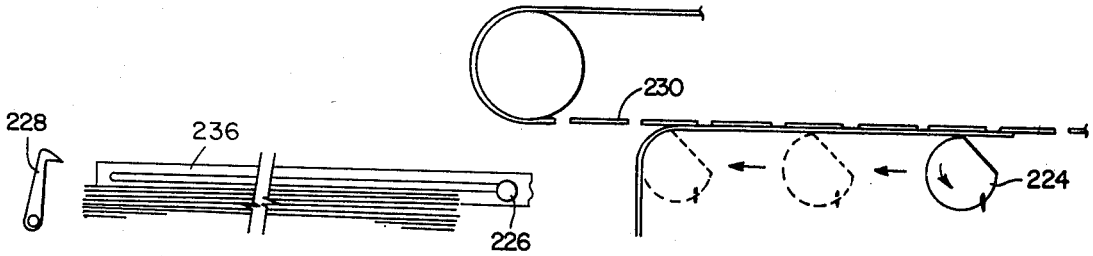

The cylindrical element 224 is then caused to move in an arc, as shown in FIG. 15C, up and over the separating rod 226 and then passes horizontally across the top of the feed stack 10. The separating rod 226 can be mounted in a framework 236 similar to that shown in FIG. 13G so that the separating rod 226 is spring biased against the drawing force of the workpiece 20. Causing the workpiece 20 to bend around the separating rod 226 and to move the separating rod 226 across the fabric stack aids greatly in the separation by producing a movable bend in the fabric which disengages the threads of the workpiece 20 from the underlying layer. It will be apparent that the movement of the separating rod 226 is one half the speed of the movement of the rotatable cylinder 224 in traveling across the top of the fabric stack.

The topmost workpiece layer travels around a smaller effective radius, and hence over a shorter path, than the next underlying layer which is stuck to it. Because of this difference in the path lengths traveled, a differential separating force, acting between the two layers and tangential to their adjoining surfaces, is thereby produced.

The rotatable cylinder 224 delivers the curled up end of the workpiece 20 to a vacuum transfer belt 230 positioned above and to one side of the fabric stack 10. The vacuum grips the workpiece 20 through holes 232 in the belt in the manner well understood by those skilled in the art as the cylinder 224 is simultaneously rotated counterclockwise to disengage its needles 120' from the workpiece. On the return stroke of the cylinder 224, it presses the workpiece 20 up and in contact with the vacuum belt 230. Simultaneously the separating rod 226 returns to its original position by the force of the spring attached to it. While a particular type of transfer belt is illustrated, it should be apparent that other suitable types of transfer belts may be utilized such as belts having cam operated grippers thereon.

One feature of this embodiment which is not disclosed in the embodiments described heretofore, is that while the workpiece 20 is separated from the stack 10, it is also inverted. The delivery of the separated and inverted workpiece to one of two locations by the belt 230 is under separate control. The vacuum on the belt over the first and second locations is alternately and sequentially closed off to cause the pieces to be dropped in succession at the first location and then the second location.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. Apparatus for sequentially separating layers of stuck together fabric workpieces from a single feed stack, the apparatus comprising a movable separating bar positioned above the topmost layer, means for selectively engaging the topmost layer near one edge thereof, means for moving the engaging means while they are engaged with the topmost layer, over the separating bar and for thereafter moving the engaging means across the topmost workpiece, and means for moving the separating bar behind the moving engaging means to produce a bend in the topmost workpiece, which bend moves across the topmost workpiece during its separation from the stack, whereby the topmost layer travels around a narrower radius, and hence over a shorter path, than the next underlying layer stuck to the topmost layer so that a differential separating force acting between the two layers and tangential to their adjoining surfaces is thereby produced.

2. Apparatus as recited in claim 1, further comprising belt means for receiving and transporting the separated workpiece.

3. Apparatus as recited in claim 1 wherein the engaging means include a rotatable element and a straight needle mounted in the rotatable element so as to project exteriorly of the element.

* * * * *